US007508916B2

(12) United States Patent
Frontera et al.

(10) Patent No.: US 7,508,916 B2
(45) Date of Patent: Mar. 24, 2009

(54) CONVECTIVELY COOLED X-RAY TUBE TARGET AND METHOD OF MAKING SAME

(75) Inventors: Mark A. Frontera, Clifton Park, NY (US); Christopher David Unger, Brookfield, WI (US)

(73) Assignee: General Electric Company, Niskayuna, NY (US)

( * ) Notice: Subject to any disclaimer, the term of this patent is extended or adjusted under 35 U.S.C. 154(b) by 39 days.

(21) Appl. No.: 11/608,328

(22) Filed: Dec. 8, 2006

(65) Prior Publication Data

US 2008/0137812 A1 Jun. 12, 2008

(51) Int. Cl.
*H01J 35/10* (2006.01)

(52) U.S. Cl. ..... 378/130; 378/141; 378/144; 378/200

(58) Field of Classification Search ..... 378/130, 378/141, 144, 200
See application file for complete search history.

(56) References Cited

U.S. PATENT DOCUMENTS

| | | | | | |
|---|---|---|---|---|---|
| 2,900,543 | A * | 8/1959 | Heuse | ..... | 378/130 |
| 4,238,706 | A * | 12/1980 | Yoshihara et al. | ..... | 378/34 |
| 4,455,504 | A * | 6/1984 | Iversen | ..... | 313/30 |
| 4,622,687 | A * | 11/1986 | Whitaker et al. | ..... | 378/130 |
| 4,788,705 | A * | 11/1988 | Anderson | ..... | 378/121 |
| 4,928,296 | A * | 5/1990 | Kadambi | ..... | 378/141 |
| 4,945,562 | A | 7/1990 | Staub | | |
| 5,018,181 | A | 5/1991 | Iversen et al. | | |
| 5,150,398 | A * | 9/1992 | Nishioka et al. | ..... | 378/132 |
| 5,384,820 | A * | 1/1995 | Burke | ..... | 378/135 |
| 5,541,975 | A * | 7/1996 | Anderson et al. | ..... | 378/130 |
| 6,393,901 | B1 | 5/2002 | Levesque et al. | | |
| 6,430,260 | B1 * | 8/2002 | Snyder | ..... | 378/130 |
| 6,636,583 | B2 * | 10/2003 | Ratzmann et al. | ..... | 378/133 |
| 6,807,348 | B2 | 10/2004 | Lu et al. | | |
| 6,940,946 | B2 * | 9/2005 | Kutschera | ..... | 378/130 |
| 7,025,502 | B2 * | 4/2006 | Freudenberger et al. | .... | 378/200 |
| 7,187,757 | B2 * | 3/2007 | Saint-Martin et al. | ..... | 378/130 |
| 2004/0213379 | A1 | 10/2004 | Bittl | | |
| 2006/0013364 | A1 | 1/2006 | Sakata et al. | | |

* cited by examiner

*Primary Examiner*—Edward J Glick
*Assistant Examiner*—Thomas R Artman
(74) *Attorney, Agent, or Firm*—Joseph J. Christian

(57) ABSTRACT

An anode assembly includes a rotatable hub having a rotation axis and having a cooling passage formed therethrough and a ferrofluid seal attached to the rotatable hub, the ferrofluid seal fluidically separating a first volume containing the target from a second volume. A target is attached to the rotatable hub, the target having a rotation axis coincident with the rotation axis of the rotatable hub and having a chamber formed therein fluidically coupled to the cooling passage, the target having a focal track material attached to an outer face of the target.

24 Claims, 8 Drawing Sheets

CONVECTIVELY COOLED X-RAY TUBE TARGET AND METHOD OF MAKING SAME

BACKGROUND OF THE INVENTION

The present invention relates generally to x-ray tubes and, more particularly, to a convectively cooled x-ray target.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner or an inspection CT device.

X-ray tubes typically include a cathode that provides a focused electron beam that is accelerated across an anode-to-cathode vacuum gap and produces x-rays upon impact with a disc-shaped anode target. Because of the high temperatures generated when the electron beam strikes the target, it is necessary to rotate the target at high rotational speed. The target is typically rotated by an iron stator structure with copper windings coupled to an induction motor having a cylindrical rotor built into a cantilevered axle that supports the target.

Traditionally, rotating anodes have a heat storage unit thermally attached to the rotating target that stores accumulated thermal energy during operation of the x-ray tube and dissipates the stored thermal energy via radiation heat transfer. Because the target is cooled primarily via radiation heat transfer, the cooling process is slow, and the peak power that can be applied to the focal spot is, thus, limited. Furthermore, the bulk temperature of the rotating target is a result of the average power that is applied, and, for increased average power applied to the target, the peak power that can be applied is further limited.

The operating conditions of newer generation x-ray tubes have placed increasing demands on x-ray tube targets. Image quality of for instance a CT system derives from the peak power that may be impinged on a target from the cathode. Image quality is also related to the size of the focal spot, and in recent years, the imaging industry has desired to decrease the size of the focal spot accordingly, thereby increasing the focal spot loading and the focal track loading. Furthermore, with increased gantry rotational speeds and more aggressive protocols, patient throughput has increased as well, thereby increasing the average power that is applied to an x-ray tube target and increasing stresses on the rotating anodes.

Therefore, it would be desirable to have an apparatus with efficient cooling of a target track therein to enable increased peak and average power which may be applied to the target track.

BRIEF DESCRIPTION OF THE INVENTION

The present invention provides an apparatus that overcomes the aforementioned drawbacks.

According to one aspect of the present invention, an anode assembly includes a rotatable hub having a rotation axis and having a cooling passage formed therethrough and a ferrofluid seal attached to the rotatable hub, the ferrofluid seal fluidically separating a first volume containing the target from a second volume. A target is attached to the rotatable hub, the target having a rotation axis coincident with the rotation axis of the rotatable hub and having a chamber formed therein fluidically coupled to the cooling passage, the target having a focal track material attached to an outer face of the target.

In accordance with another aspect of the invention, a method of manufacturing an x-ray tube includes forming a rotatable hub having a cooling channel extending therethrough and assembling a target having a cavity extending thereinto and a focal track material attached to a face of the target. The method further includes attaching a ferrofluid seal to the rotatable hub, attaching the target to the rotatable hub, and fluidly coupling the cooling channel to the cavity.

In accordance with yet another aspect of the present invention, a CT system includes a rotatable gantry, a heat exchanger, and an x-ray tube attached to the rotatable gantry. The x-ray tube includes a cylindrical shaft having a passageway formed therethrough in fluid contact with the heat exchanger, a ferrofluid seal attached to the cylindrical shaft forming a vacuum seal thereon, and a target having a convective cooling system formed therein.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to the use of an x-ray tube as used in a computed tomography (CT) system. However, it will be appreciated by those skilled in the art that the present invention is equally applicable for use in other systems that require the use of an x-ray tube. Such uses include, but are not limited to, x-ray imaging systems (for medical and non-medical use), mammography imaging systems, x-ray diffraction systems, and radiographic (RAD) systems, ranging in x-ray energies, but not limited to, for instance 25 KeV to 500 KeV.

Moreover, the present invention will be described with respect to use in a conventional rotating anode x-ray tube. However, one skilled in the art will further appreciate that the present invention is equally applicable for other systems that require operation of a high intensity focal spot on a material that will limit the overall peak or average power that may be applied thereto.

The present invention will be described with respect to a "third generation" CT medical imaging scanner, but is equally applicable with other CT systems, such as a baggage scanner or a scanner for other non-destructive industrial uses. Furthermore, the present invention is equally applicable to systems and apparatus using multiple x-ray tubes, multiple x-ray detectors, and combinations thereof.

Figure 1:
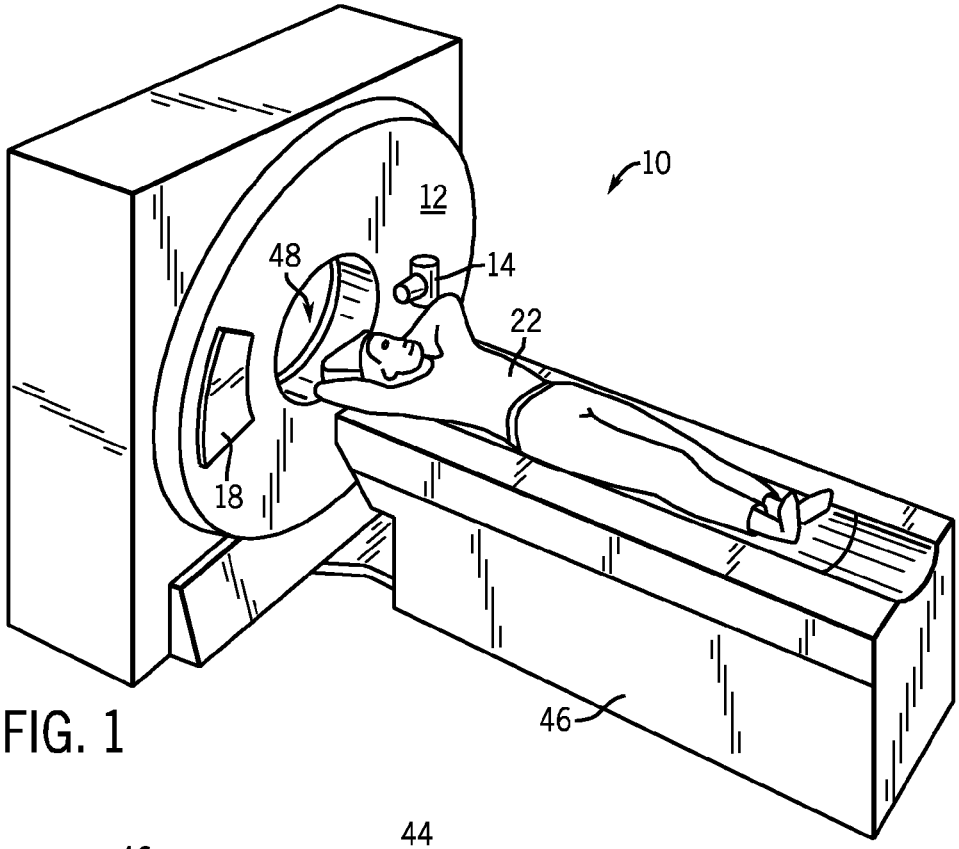
FIG. 1 is a pictorial view of a CT imaging system incorporating an embodiment of the present invention.
Figure 2:
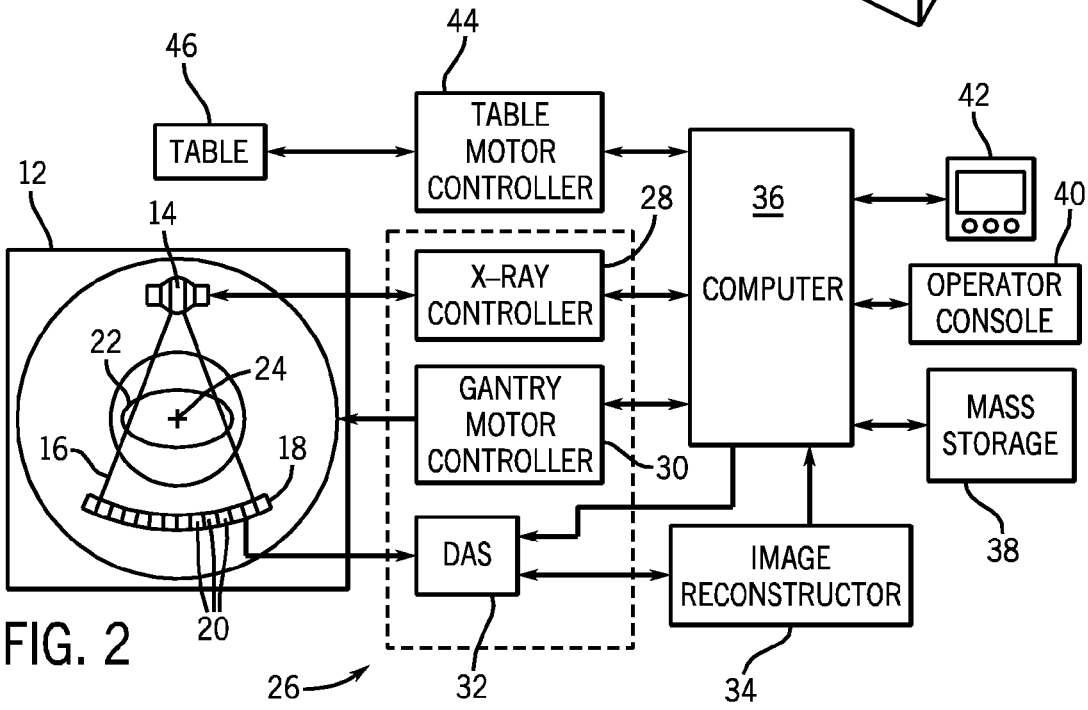
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray tube 14 that projects a beam of x-rays 16 toward a detector array 18 on the opposite side of the gantry 12. X-ray tube 14 is cooled by a heat exchanger (not shown) mounted to gantry 12. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray tube 14 are governed by a control mechanism 26 of CT system 10. Control mechanism 26 includes an x-ray controller 28 that provides power and timing signals to an x-ray tube 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves portions of patient 22 through a gantry opening 48.

Figure 3:
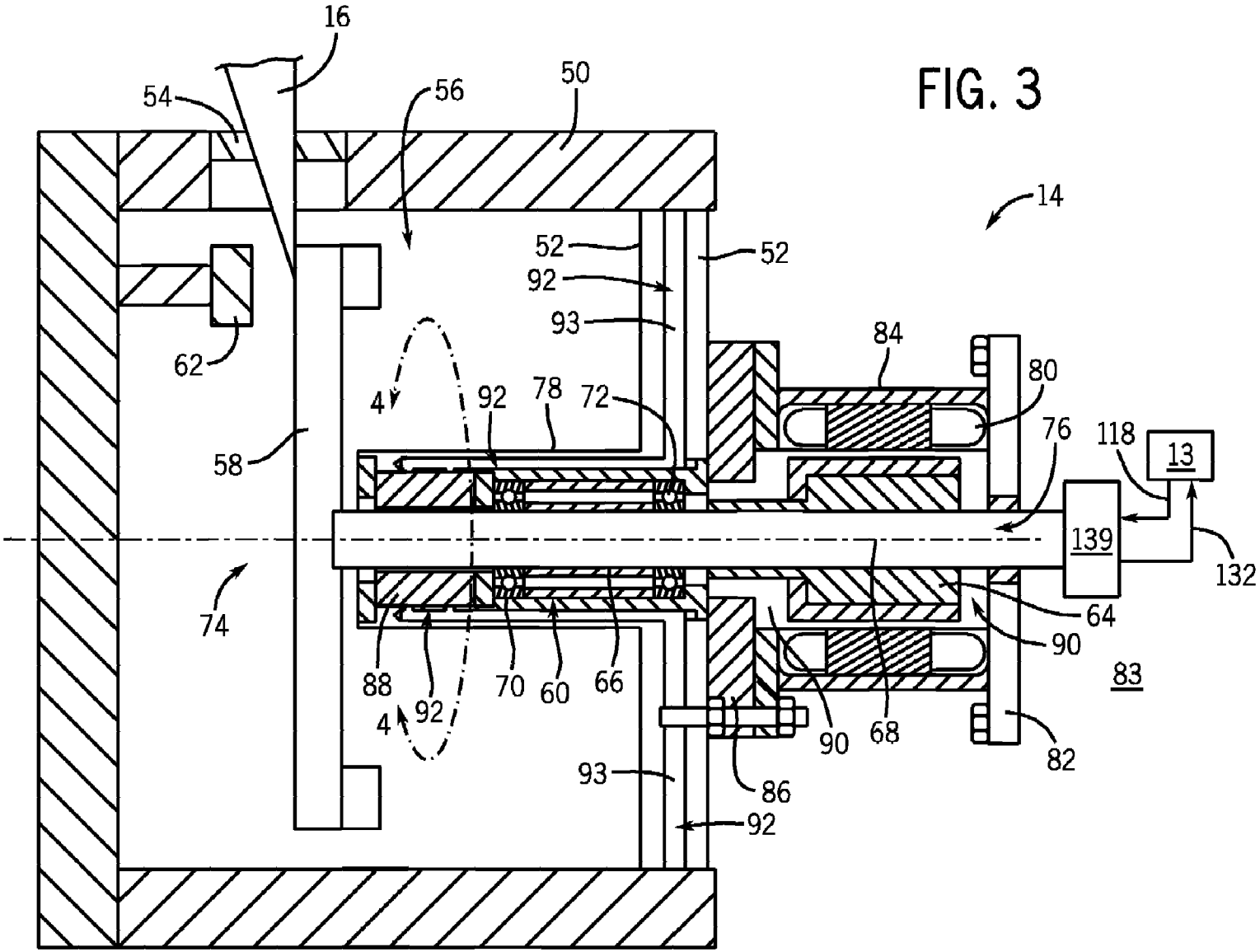
FIG. 3 illustrates a cross-sectional view of an x-ray tube incorporating an embodiment of the present invention.

FIG. 3 illustrates a cross-sectional view of the x-ray tube 14 of FIG. 1 according to an embodiment of the present invention. The x-ray tube 14 includes a frame 50 and an anode backplate 52. Frame 50 and anode backplate 52 enclose an x-ray tube volume 56 having a high vacuum formed therein, which houses an anode, or target, 58 and a cathode 62. X-rays 16 are produced when high-speed electrons are suddenly decelerated when directed from the cathode 62 to the target 58 via a potential difference therebetween of, for example, 60 thousand volts or more in the case of CT applications. The x-rays 16 are emitted through a radiation emission passage 54 toward a detector array, such as detector array 18 of FIG. 2. To avoid overheating the target 58 from the electrons, a rotor 64 and a center shaft 66 rotate the target 58 at a high rate of speed about a centerline 68 at, for example, 90-250 Hz. Target 58 is attached to center shaft 66 at a first end 74, and the rotor 64 is attached to center shaft 66 at a second end 76.

A bearing assembly 60 includes a front bearing 70 and a rear bearing 72, which together support center shaft 66 to which target 58 is attached. In a preferred embodiment, front and rear bearings 70, 72 are lubricated using grease or oil. Front and rear bearings 70, 72 are attached to center shaft 66 and are mounted in a stem 78, which is supported by anode backplate 52. A stator 80 rotationally drives rotor 64 attached to center shaft 66 for rotationally driving target 58 attached to center shaft 66.

X-ray tube 14 includes a ferrofluid seal assembly 88 positioned about center shaft 66 that, together with a mounting plate 82, a stator housing 84, a stator mount structure 86, and stem 78, defines an antechamber 90 into which bearing assembly 60 and rotor 64 are positioned and into which the second end 76 of center shaft 66 extends. Center shaft 66 extends from x-ray tube volume 56, through ferrofluid seal assembly 88, and into antechamber 90. In one embodiment, center shaft 66 extends through mounting plate 82 and into an environment 83. The ferrofluid seal assembly 88 hermetically seals x-ray tube volume 56 from antechamber 90 while allowing center shaft 66 to rotate therein. Accordingly, ferrofluid seal assembly 88 allows direct access to a cooling inlet 118 and a cooling outlet 132 outside the x-ray tube volume 56 having a high vacuum formed therein.

Cooling passage 92 carries coolant 93 through anode backplate 52 and into stem 78 to cool ferrofluid seal assembly 88 thermally connected to stem 78. Coolant 93 flows through cooling passage 92 thereby cooling ferrofluid seal assembly 88. Coolant 93 also cools bearing assembly 60 by flowing in thermal contact therewith. Cooling inlet 118 and outlet 132 are connected to heat exchanger 13 via a single or multiple rotating liquid seal(s) 139 such as a Deublin™ and the like. A Deublin™ seal is available from Deublin Company at 2050 Norman Drive West, Waukegan, Ill. 60085-6747.

Figure 4:
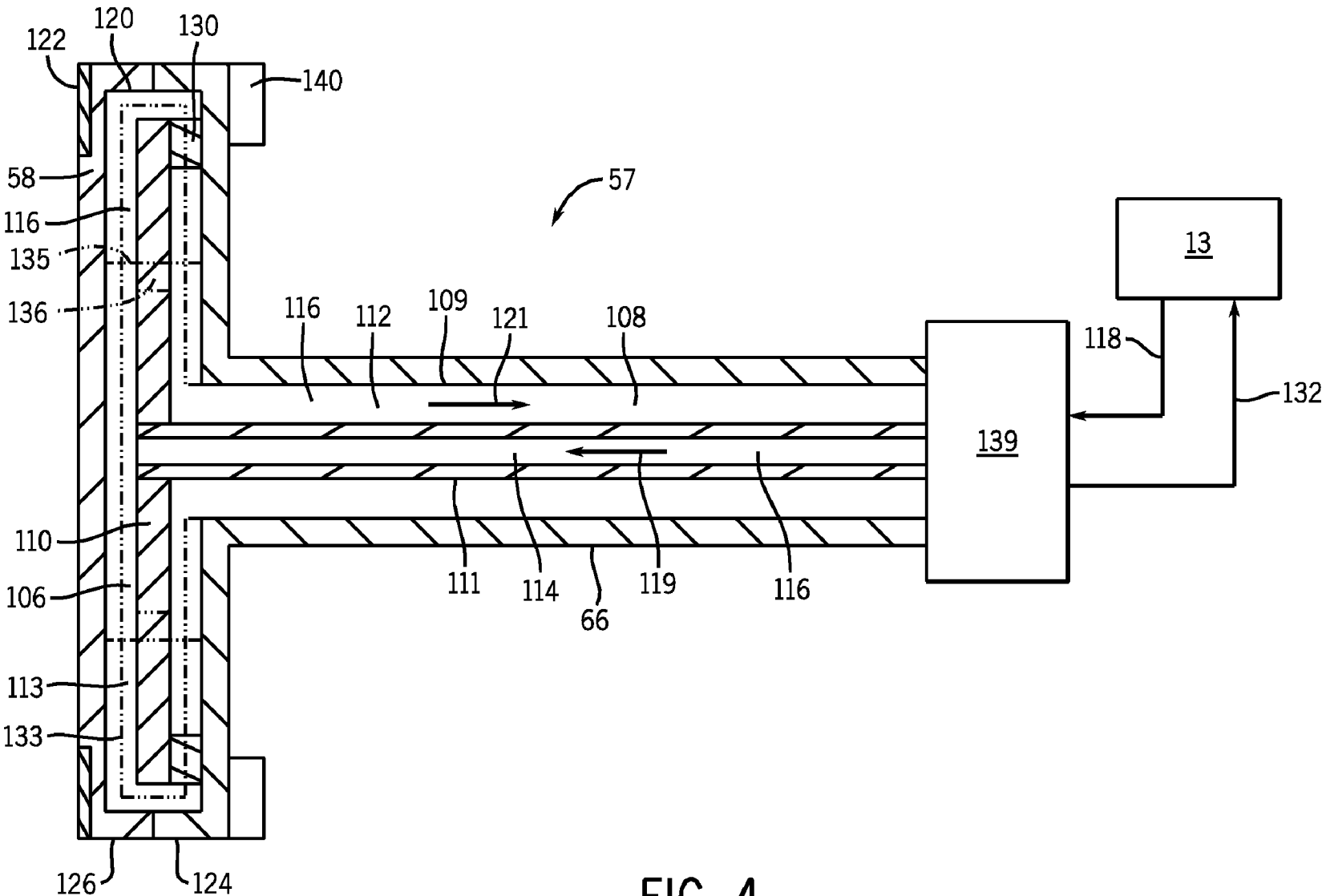
FIG. 4 illustrates an x-ray tube target according to an embodiment of the present invention.

FIG. 4 illustrates a cross-sectional view of a convective cooling system 57 for target 58 and center shaft 66 according to an embodiment of the present invention. A chamber 106, also referred to as a cavity or hollow area, is formed in target 58 as a first half 124 target cap of target 58 and a second half 126 target cap of target 58 are joined together. As will be described, chamber 106 allows fluid convective cooling of target 58. Prior to joining halves 124, 126 together, a flow divider 110 having a stem 111 and a feed channel 114 formed through the stem 111 is positioned therebetween such that, when halves 124, 126 are joined together, a clearance 113 is formed between halves 124, 126 and flow divider 110. A sleeve or hydrodynamic bearing (not shown) may be added to support the mass of the cooling system members 111 and 136. A passage 108, also referred to as a coolant channel or passageway, is formed through center shaft 66. Center shaft 66 is joined to target 58 such that stem 111 of flow divider 110 passes through passage 108. A clearance, or return channel, 112 is formed between a wall 109 of passage 108 and stem 111. Clearance 113 is, thus, fluidly connected to clearance 112 and to feed channel 114. Flow divider 110 may be stationary with respect to x-ray tube 14, or may be rigidly coupled to target 58 through contact points in the stem 111 or target chamber 106. Outer surfaces of target 58 may be coated with an emissive coating to enhance radiative heat transfer and cooling of target 58.

A coolant 116 is fed, or pumped, into feed channel 114 at inlet 118 from heat exchanger 13 in direction 119. Once passed through clearance 113 of the target 58, coolant 116 returns 121 through return channel 112. Coolant 116 may include, but is not limited to, one or more of dielectric insulating oil, cooling oil, water, ethylene glycol, propylene glycol, and mixtures thereof, and the like. Coolant 116 flows through feed channel 114 and into chamber 106. Coolant 116 flows into outer radial region 120, which, in one embodiment, is adjacent to focal track 122 such that focal track 122 overlaps outer radial region 120. According to another embodiment, outer radial region 120 is not overlapped by focal track 122 but, instead, reaches for instance a mid-radius region shown, for example, in phantom, wherein wall 135 formed in target 58 causes clearance 136 to be formed therein between flow divider 110 and wall 135. In this embodiment, a heat storage material 140 comprising carbon, such as graphite or a carbon-carbon composite, may be attached to the target to augment the thermal storage of target. A faster rotation rate of the anode may be obtained if an all metal design of the target 58 is applied. One skilled in the art will recognize that the outer radial region 120 may extend further radially to, for instance, ¾ the radius from a center of target 58

Coolant further flows toward and through return channel 112 and outlet 132 to return to heat exchanger 13. In any of the embodiments described herein, the walls of chamber 106 may be alternatively coated or plated with a thermally insulating material or highly unidirectional conductive material 133 for protection from excessive instantaneous temperatures. One skilled in the art will recognize that the direction of flow described above may be reversed. That is, coolant 116 may be input into the cooling system 57 via an inlet at 132 and return the heat exchanger 13 via an outlet at 118 for cooling.

A plurality of turbulators or fins 130 attached to target 58 provide increased surface area for enhancing convection heat transfer within chamber 106 from target 58 to coolant 116. Turbulators or fins 130 may also break up the flow of coolant 116, thereby causing turbulence within chamber 106 to further enhance heat transfer into coolant 116. Turbulators or fins 130 also serve as a pumping mechanism to enhance pumping of coolant 116 throughout the cooling system 57 as target 58 rotates.

Still referring to FIG. 4, in operation, electrons originating from cathode 62 (shown in FIG. 3) are caused to impinge upon target 58 at focal track 122. Coolant 116 is caused to flow into feed channel 114 and is pumped throughout target 58. As described above, the pumping may be further enhanced by the operation of turbulators or fins 130. Heat generated within focal track 122 is conducted through target 58 and convected to coolant 116, thereby resulting in increased temperature of coolant 116. Coolant 116 exits return channel 112 and is caused to leave the target assembly 58, 66 at outlet 132 through liquid seal 139 for cooling by heat exchanger 13. As such, heat generated at focal track 122 is directly cooled by coolant 116 and is efficiently carried away to the heat exchanger 13, thereby increasing the amount of peak power and average power that may be applied to target 58. Coolant 116 may cause heat generated at focal track 122 to be transferred via single or multi phase heat transfer mechanisms.

Figure 5:
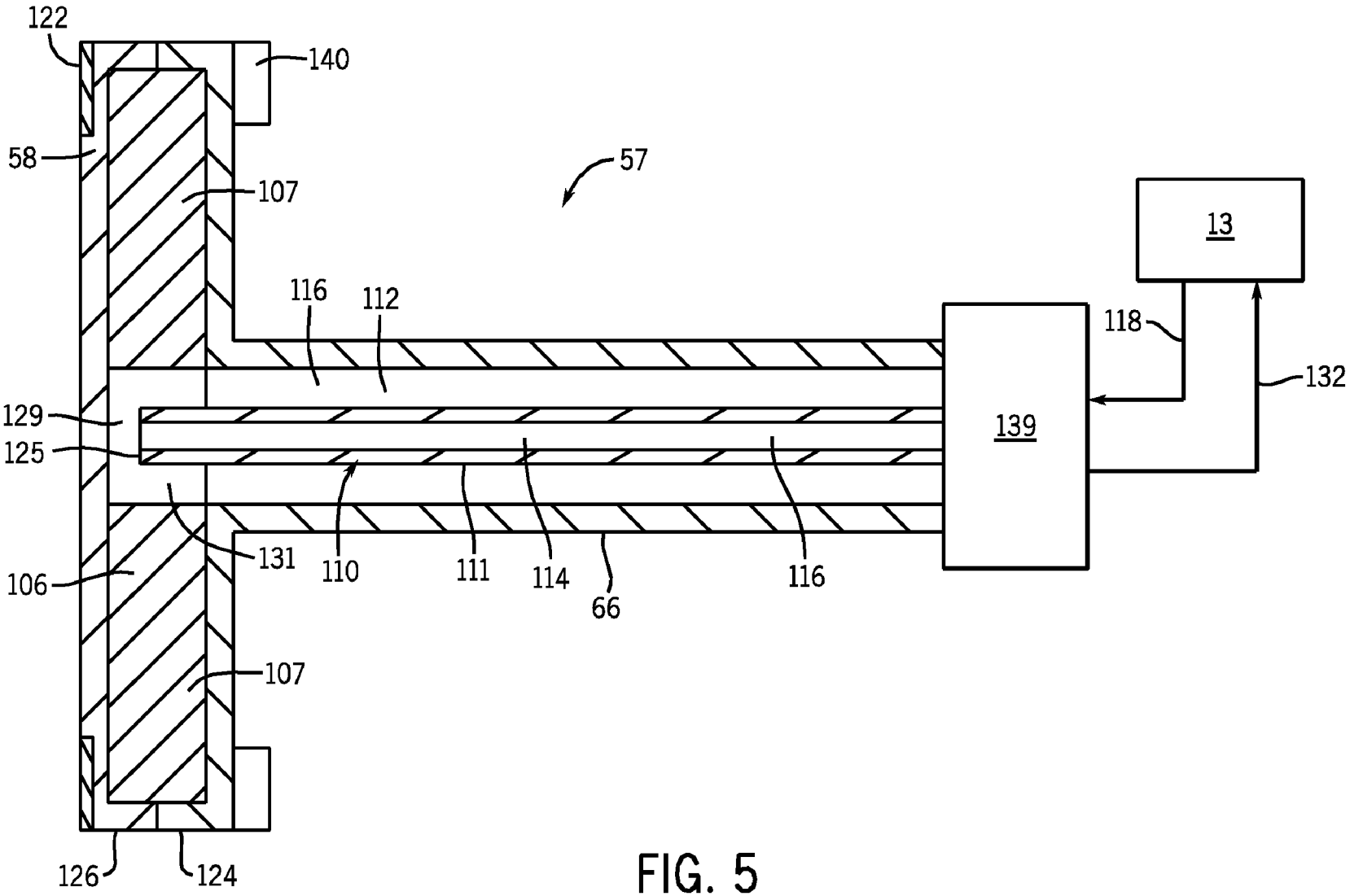
FIG. 5 illustrates an x-ray tube target according to an embodiment of the present invention.

FIG. 5 illustrates a cross-sectional view of the convective cooling system 57 for target 58 and center shaft 66 according to an alternative embodiment of the present invention. A thermally conductive material 107, such as glidcop, is placed in chamber 106 between first and second halves 124, 126 of target 58. Preferably, thermally conductive material 107 is an annular ring having a bore 125 formed centrally therethrough. Stem 111 of flow divider 110 extends into bore 125 such that a clearance 129 is formed between the stem 111 and second half 126 and such that a clearance 131 is formed between the stem 111 and the thermally conductive material 107. Coolant 116 at region 131 thus contacts the thermally conductive material 107 and absorbs heat therein. Coolant 116 is caused to flow from heat exchanger 13 to inlet 118, through liquid seal 139, and into feed channel 114. Coolant 116 then flows through clearances 129, 131 and back to liquid seal 139 through return channel 112. Coolant 116 exits liquid seal 139 at outlet 132 and flows to heat exchanger 13. As such, heat generated at focal track 122 is conductively cooled by material 107, and material 107 is directly and conductively cooled by coolant 116 thereby increasing the amount of peak power and average power that may be applied to target 58. One skilled in the art will recognize that region 131 may be extended radially into chamber 106 and coolant 116 may be directed thereto by either expanding chamber 107, and/or by extending flow divider 110 accordingly. One skilled in the art will recognize that thermally conductive material 107, although illustrated to overlap radially with focal track 122, may stop radially short thereof, thus having conventional target cap material radially positioned near focal track 122. One skilled in the art will recognize that heat storage material 140 may be attached to first half 124 to augment thermal performance of target 58.

Figure 6:
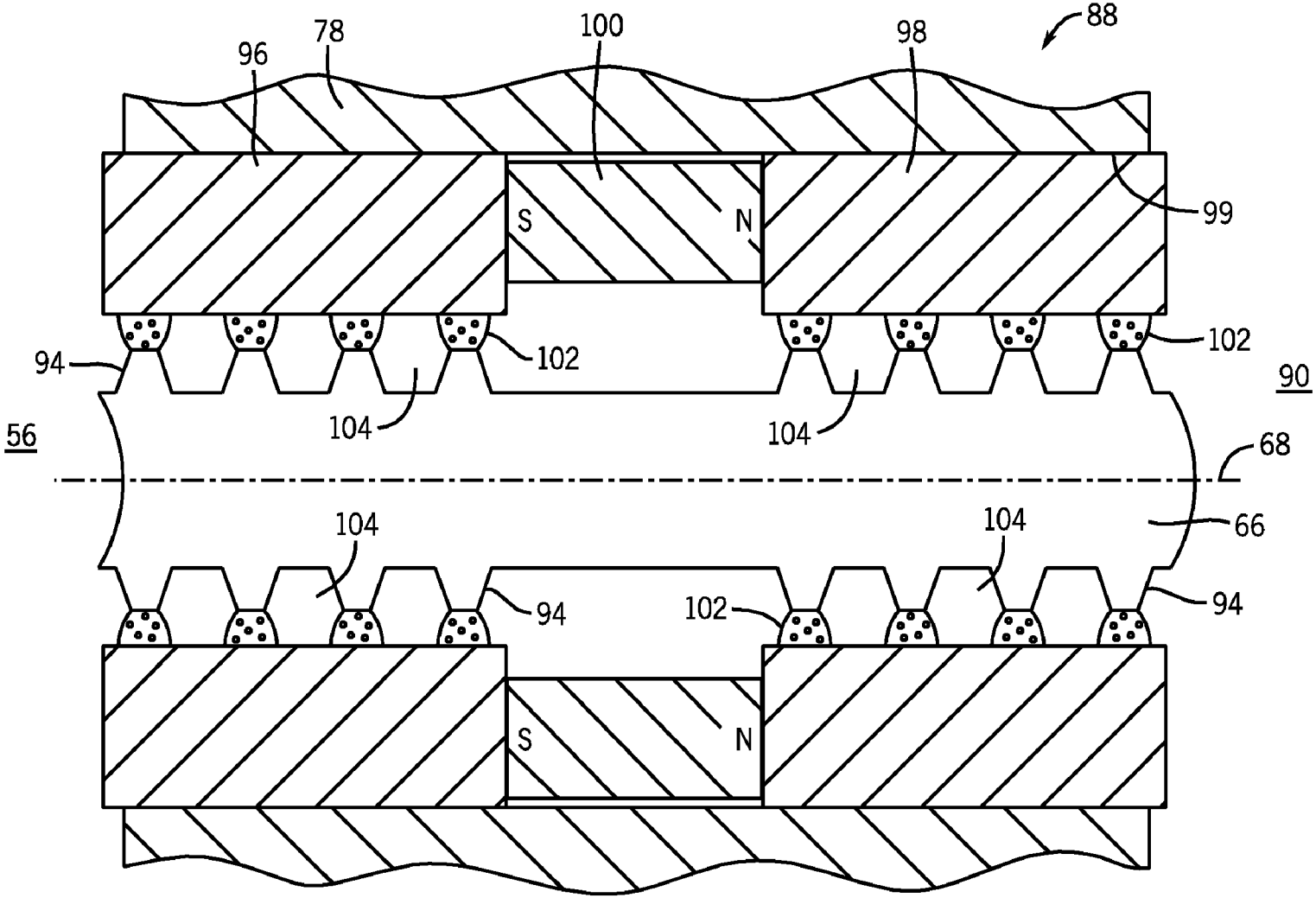
FIG. 6 illustrates a cross-sectional view of the ferrofluid seal assembly shown in FIG. 3.

FIG. 6 illustrates a cross-sectional view of the ferrofluid seal assembly 88 of FIG. 3. A ferrofluid seal typically includes a series of annular regions between a rotating component and a non-rotating component. The annular regions are occupied by a ferrofluid that is typically a hydrocarbon-based, silicone-based, or fluorocarbon-based oil with a suspension of magnetic particles therein. The particles are coated with a stabilizing agent, or surfactant, which prevents agglomeration of the particles in the presence of a magnetic field. When in the presence of a magnetic field, the ferrofluid is caused to form a seal between each of the annular regions. The seal on each annular region, or stage, can separately withstand pressure of typically 1-3 psi and, when each stage is placed in series, the overall assembly can withstand pressure varying from atmospheric pressure on one side to high vacuum on the other side.

A pair of annular pole pieces 96, 98 abut an interior surface 99 of stem 78 and encircle center shaft 66. An annular permanent magnet 100 is positioned between pole piece 96 and pole piece 98. In a preferred embodiment, center shaft 66 includes annular rings 94 extending therefrom toward pole pieces 96, 98. Alternatively, however, pole pieces 96, 98 may include annular rings extending toward center shaft 66 instead of, or in addition to, annular rings 94 of center shaft 66. A ferrofluid 102 is positioned between each annular ring 94 and corresponding pole piece 96, 98, thereby forming cavities 104. Magnetization from permanent magnet 100 retains the ferrofluid 102 positioned between each annular ring 94 and corresponding pole piece 96, 98 in place. In this manner, multiple stages of ferrofluid 102 are formed that hermetically seal the pressure of gas in the antechamber 90 of FIG. 3 from a high vacuum formed in x-ray tube volume 56. As shown, FIG. 6 illustrates 8 stages of ferrofluid 102. Each stage of ferrofluid 102 withstands 1-3 psi of gas pressure. Accordingly, one skilled in the art will recognize that the number of stages and spacing of ferrofluid 102 may be increased or decreased, depending on the difference in pressure between the antechamber 90 and the x-ray tube volume 56.

Figure 7:
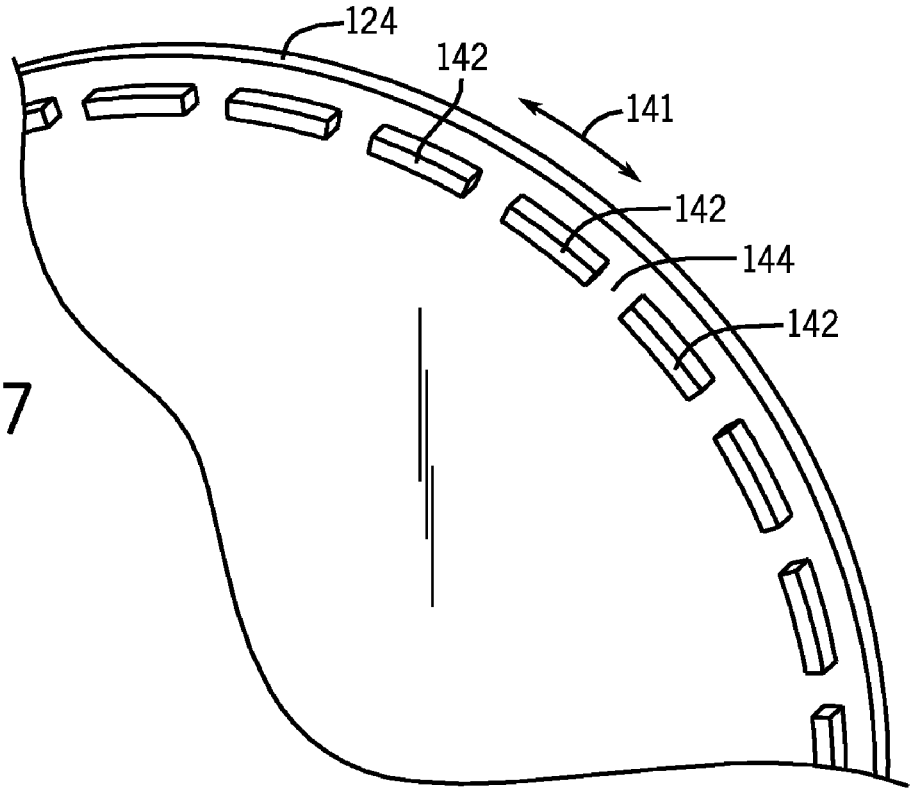
FIG. 7 illustrates a target cap of FIG. 4 according to an embodiment of the present invention.

FIG. 7 illustrates a perspective view of a plurality of turbulators/fins 142 attached to first half 124 or to second half 126 (not shown) according to an embodiment of the present invention. Turbulators/fins 142 have a generally rectangular cross-section, having a long rectangular axis that is generally along a circumferential direction 141 of flow divider 110. Turbulators/fins 142 have a space 144 therebetween, thereby allowing coolant 116 of FIG. 4 to flow therearound.

Figure 8:
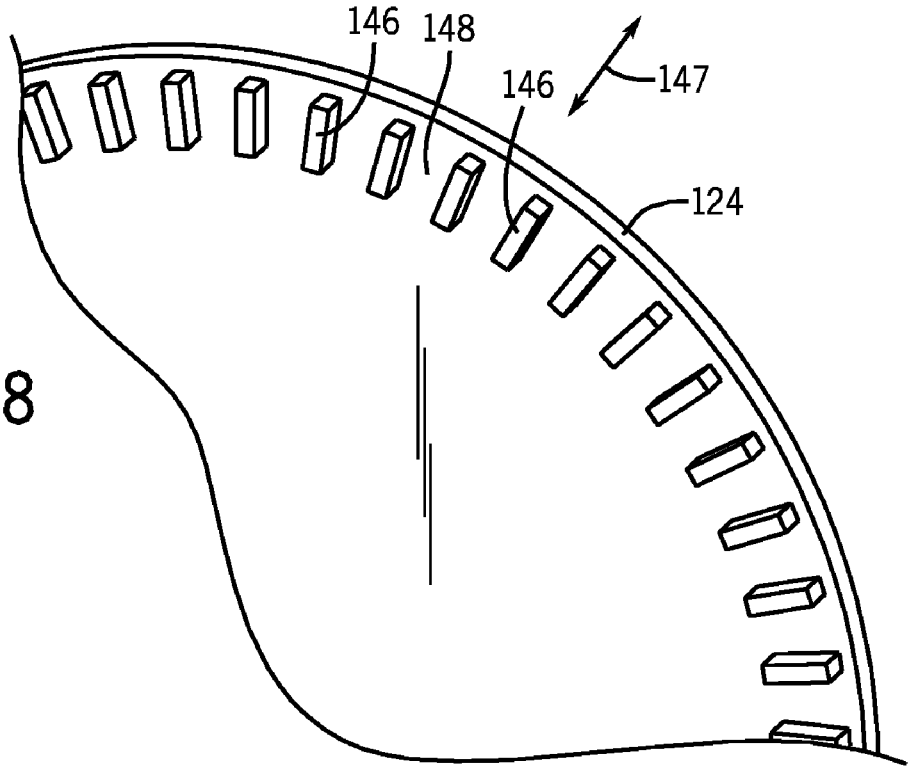
FIG. 8 illustrates a target cap of FIG. 4 according to an embodiment of the present invention.

FIG. 8 illustrates a perspective view of a plurality of turbulators/fins 146 attached to first half 124 or to second half 126 (not shown) according to an embodiment of the present invention. Turbulators/fins 146 have a generally rectangular cross-section, having a long rectangular axis that is generally along a radial direction 147 of flow divider 110. Turbulators/fins 146 have a space 148 therebetween, thereby allowing coolant 116 of FIG. 4 to flow therearound.

Figure 9:
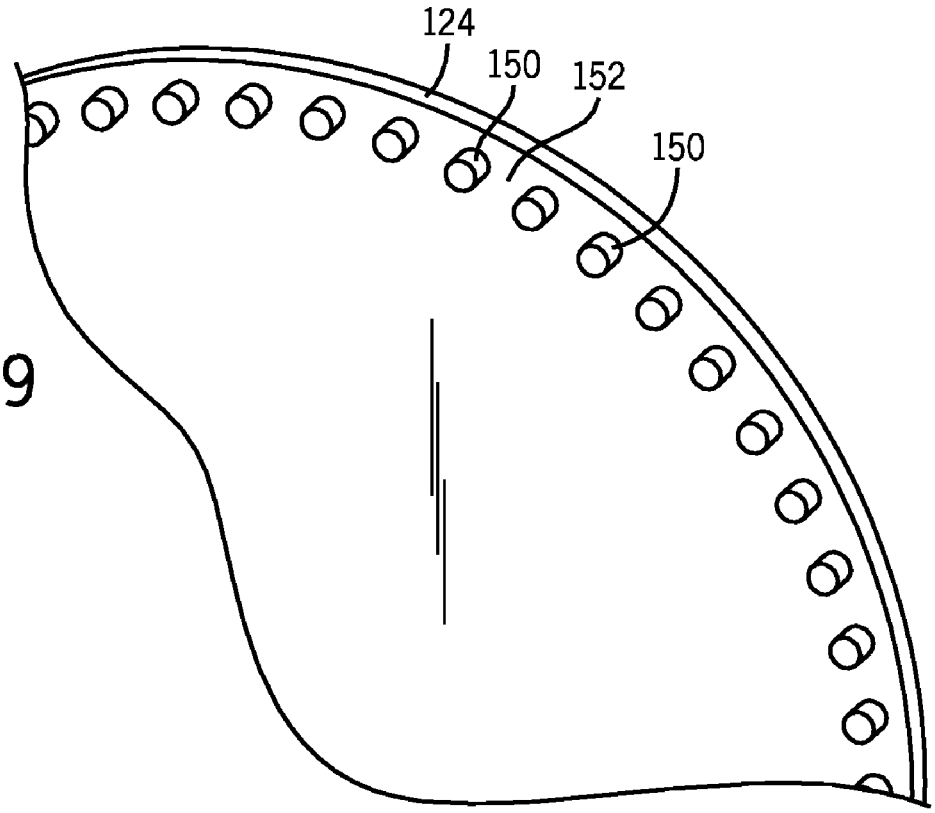
FIG. 9 illustrates a target cap of FIG. 4 according to an embodiment of the present invention.

FIG. 9 illustrates a perspective view of a plurality of turbulators/fins 150 attached to first half 124 or to second half 126 (not shown) according to an embodiment of the present invention. Turbulators/fins 150 have a generally circular cross-section. Turbulators/fins 150 have a space 152 therebetween, thereby allowing coolant 116 of FIG. 4 to flow therearound.

Figure 10:
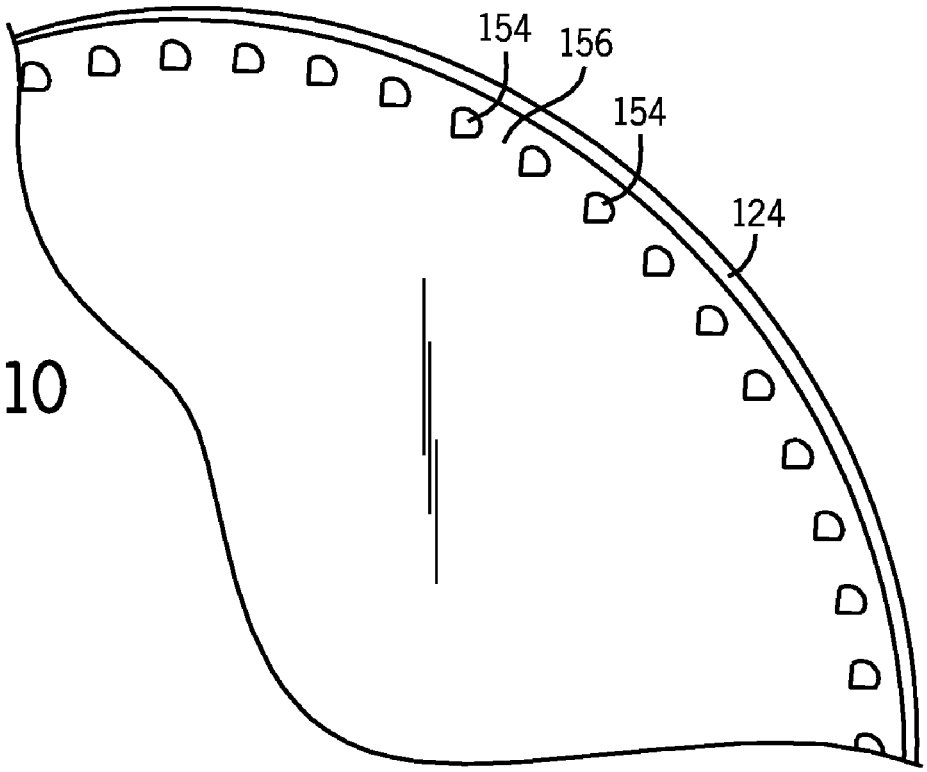
FIG. 10 illustrates a target cap of FIG. 4 according to an embodiment of the present invention.

FIG. 10 illustrates a perspective view of a plurality of turbulators/fins 154 attached to first half 124 or to second half 126 (not shown) according to an embodiment of the present invention. Turbulators/fins 154 have a generally triangular profile and have a point formed thereon. Turbulators/fins 154 have a space 156 therebetween, thereby allowing coolant 116 of FIG. 4 to flow therearound.

Figure 11:
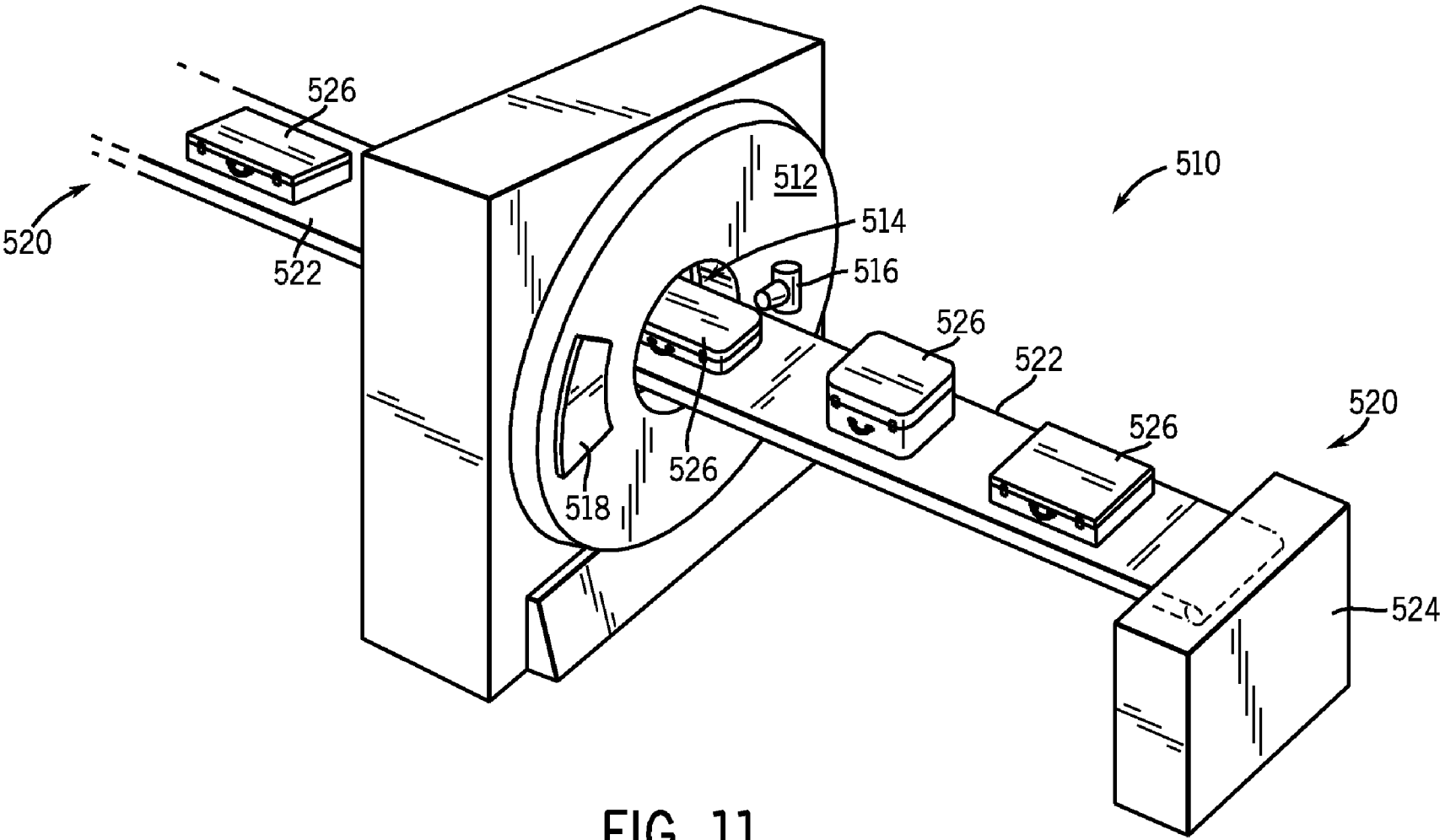
FIG. 11 is a pictorial view of a CT system for use with a non-invasive package inspection system incorporating an embodiment of the present invention.

FIG. 11 is a pictorial view of a CT system for use with a non-invasive package inspection system. Package/baggage inspection system 510 includes a rotatable gantry 512 having an opening 514 therein through which packages or pieces of baggage may pass. The rotatable gantry 512 houses a high frequency electromagnetic energy source 516 according to an embodiment of the present invention, as well as a detector assembly 518 having scintillator arrays comprised of scintillator cells. A conveyor system 520 is also provided and includes a conveyor belt 522 supported by structure 524 to automatically and continuously pass packages or baggage pieces 526 through opening 514 to be scanned. Objects 526 are fed through opening 514 by conveyor belt 522, imaging data is then acquired, and the conveyor belt 522 removes the packages 526 from opening 514 in a controlled and continuous manner. As a result, postal inspectors, baggage handlers, and other security personnel may non-invasively inspect the contents of packages 526 for explosives, knives, guns, contraband, etc. Additionally, such systems may be used in industrial applications for non-destructive evaluation of parts and assemblies.

Therefore, according to one embodiment of the present invention, an anode assembly includes a rotatable hub having a rotation axis and having a cooling passage formed therethrough and a ferrofluid seal attached to the rotatable hub, the ferrofluid seal fluidically separating a first volume containing the target from a second volume. A target is attached to the rotatable hub, the target having a rotation axis coincident with the rotation axis of the rotatable hub and having a chamber formed therein fluidically coupled to the cooling passage, the target having a focal track material attached to an outer face of the target.

In accordance with another embodiment of the invention, a method of manufacturing an x-ray tube includes forming a rotatable hub having a cooling channel extending therethrough and assembling a target having a cavity extending thereinto and a focal track material attached to a face of the target. The method further includes attaching a ferrofluid seal to the rotatable hub, attaching the target to the rotatable hub, and fluidly coupling the cooling channel to the cavity.

In accordance with yet another embodiment of the invention, a CT system includes a rotatable gantry, a heat exchanger, and an x-ray tube attached to the rotatable gantry. The x-ray tube includes a cylindrical shaft having a passageway formed therethrough in fluid contact with the heat exchanger, a ferrofluid seal attached to the cylindrical shaft forming a vacuum seal thereon, and a target having a convective cooling system formed therein.

The present invention has been described in terms of the preferred embodiment, and it is recognized that equivalents, alternatives, and modifications, aside from those expressly stated, are possible and within the scope of the appending claims.

What is claimed is:

1. An anode assembly for an x-ray tube, the anode assembly comprising:

a rotatable hub having a rotation axis and having a cooling passage formed therethrough;

a ferrofluid seal attached to the rotatable hub, the ferrofluid seal fluidically separating a first volume containing the target from a second volume;

a target attached to the rotatable hub, the target having a rotation axis coincident with the rotation axis of the rotatable hub and having a chamber formed therein fluidically coupled to the cooling passage, the target having a focal track material attached to an outer face of the target, wherein the focal track material and the chamber do not overlap; and a heat storage material attached to an external surface of the target and thermally connected to the focal track material.

2. The anode assembly of claim 1 further comprising a flow divider having an inlet feed channel and positioned within the chamber such that a clearance is formed between the flow divider and a wall of the chamber and extending into the cooling passage such that a clearance is formed between the flow divider and a wall of the cooling passage.

3. The anode assembly of claim 1 further comprising an emissive coating attached to an outer surface of the target.

4. The anode assembly of claim 1 further comprising at least one flow turbulator positioned within the cooling passage.

5. The anode assembly of claim 4 wherein the chamber radially extends toward the outer edge of the target.

6. The anode assembly of claim 1 wherein the heat storage material comprises carbon.

7. The anode assembly of claim 6 wherein the heat storage material is one of graphite and a carbon-carbon composite.

8. The anode assembly of claim 1 wherein the heat storage material and the focal track material are on opposing faces of the target.

9. The anode assembly of claim 1 further comprising a coolant positioned within the chamber.

10. The anode assembly of claim 9 wherein the coolant comprises at least one of a dielectric insulating oil, a cooling oil, water, ethylene glycol, and propylene glycol.

11. The anode assembly of claim 9 further comprising a plurality of projections attached to the target and extending into the cavity, the plurality of projections configured to contact the coolant and configured to enhance flow of the coolant within the chamber.

12. The anode assembly of claim 1 further comprising a thermally conductive material positioned within the chamber and attached to the target and fluidically coupled to the cooling passage.

13. The anode assembly of claim 1 further comprising a thermally insulating material attached to the target within the chamber.

14. A method of manufacturing an x-ray tube, the method comprising:

forming a rotatable hub having a cooling channel extending therethrough;

assembling a target having a cavity extending thereinto and a focal track material attached to a face at an outer radial region of the target, wherein the cavity does not extend to the outer radial region;

attaching a ferrofluid seal to the rotatable hub, the seal hermetically separating a first chamber from a second chamber;

positioning a first portion of a flow divider within the cavity and positioning a second portion of the flow divider within the cooling channel;

attaching the target to the rotatable hub and positioning the target in the first chamber of the x-ray tube;

attaching a bearing to the hub to support the target, wherein the bearing is lubricated via grease or oil and positioned in the second chamber; and fluidly coupling the cooling channel to the cavity.

15. The method of claim 14 further comprising pumping a coolant into the cavity to convectively cool the target.

16. The method of claim 14 further comprising positioning at least one flow turbulator within the cavity between the flow divider and the target.

17. The method of claim 14 further comprising forming the cavity to extend toward a mid-radius region of the target.

18. The method of claim 14 further comprising attaching a heat sink to the target.

19. The method of claim 14 further comprising forming the cavity to extend radially outward from a rotation centerline of the target.

20. The method of claim 14 further comprising attaching a carbon-carbon heat storage material to an external surface of the target and thermally coupled to the focal track material.

21. An imaging system comprising:

a rotatable gantry;

a heat exchanger; and an x-ray tube attached to the rotatable gantry, the x-ray tube comprising:

a cylindrical shaft having a passageway formed therethrough in fluid contact with the heat exchanger;

a ferrofluid seal attached to the cylindrical shaft forming a vacuum seal thereon; and a target having a focal track material on a first portion and a convective cooling system formed only in a second portion, the convective cooling system comprising a plurality of turbulators having an attachment surface attached to the target.

22. The imaging system of claim 21 wherein the target is connected to the cylindrical shaft, the target having a hollow area formed therein, the hollow area in fluid contact with the passageway.

23. The imaging system of claim 21 further comprising a flow divider positioned within the hollow area of the target and extending into the passageway of the cylindrical shaft such that a flow path is formed between the flow divider and a wall of the hollow area and between the flow divider and a wall of the passageway.

24. The imaging system of claim 21 wherein a shape of the attachment surface comprises one of a circular shape, a rectangular shape, and a generally triangular shape.

* * * * *